US005862889A

United States Patent [19]

Sevilleja et al.

[11] Patent Number: 5,862,889

[45] Date of Patent: Jan. 26, 1999

[54] ELEVATOR CABS

[75] Inventors: Jose Sevilleja, Madrid, Spain; Roberto Corbetta, Monza, Italy; Franck J. Det, Gien, France

[73] Assignee: Otis Elevator Company, Farmington, Conn.

[21] Appl. No.: 55,061

[22] Filed: Apr. 29, 1993

[30] Foreign Application Priority Data

May 4, 1992 [ES] Spain ..... 9200922

[51] Int. Cl.[6] ..... B66B 7/00

[52] U.S. Cl. ..... 187/414; 187/395

[58] Field of Search ..... 187/414, 250, 187/277, 280, 395, 391, 394, 397, 399

[56] References Cited

U.S. PATENT DOCUMENTS 2,525,769 10/1950 Bruns ..... 187/395

5,565,661 10/1996 Berdich et al. ..... 187/395

*Primary Examiner*—Kenneth Noland

[57] ABSTRACT

A elevator cab car operating panel has a convex cover cooperating with one of the cab walls to define an enclosed space in which a lighting source is disposed. A pair of translucent panels cooperate with the cover to allow the light to emanate from the car operating panel to provide the primary source of light for the cab. The cab wall may have a concave shape for cooperating with the convex cover to define the enclosed space.

9 Claims, 4 Drawing Sheets

ELEVATOR CABS

TECHNICAL FIELD

The present invention relates to an elevator cab and more particularly to an elevator cab operating panel.

BACKGROUND ART

Elevator cab interiors typically have lighting disposed in their ceilings and one or more car operating panels ("COP") in their walls. The lighting provides both a safety function and an aesthetic function. A disadvantage of the mounting the lighting in the ceiling is that access to the lighting is limited.

The cover of the COP comprises controls and/or information display devices for manipulating the components contained within the COP. In most instances, the cover to the COP is pivotly mounted on one side of the COP by at least one hinge to permit access to the components mounted within the COP.

Pivotly mounting the cover on one side of the COP has a number of disadvantages. In applications where the area around the COP is confined, for example, it is difficult to access the components mounted in the COP and the cover when the cover is pivoted away from the COP. As a result, it is necessary to repeatedly pivot the cover during servicing.

In applications where a wall or structure is in close proximity to only one side of the COP, the aforementioned access problem can be overcome by pivotly mounting the cover on the side of the COP away from the wall or the structure. This solution, however, mandates that there be a left and a right hand COP available. Two different COP increases the overall cost of the COP as well as the chance for error.

Accordingly, what is needed is one COP, having cab lighting, which allows access to the components mounted therein when the COP is mounted in confined spaces.

DISCLOSURE OF THE INVENTION

It is an object of the invention to make cab lighting more accessible.

It is a further object of the invention to provide a COP which may be mounted in a confined space and still provide easy access to the components contained therein.

It is a further object of the invention to concentrate cab wiring in one area and to maximize access to such wiring.

According to the invention, a car operating panel is provided having cab lighting, a backing plate, a convex cover over said backing plate, and means for allowing the light to emanate from the COP.

According to one feature of the invention, the COP concentrates the cab electrical wiring in a single zone, thereby facilitating access to the wiring from within the cab.

According to another feature of the invention, the COP has luminous components.

According to still another feature of the invention, the cover of the COP is mounted to the cab by means of a linkage which allows the COP to be mounted in a confined space and still provide easy access to the components contained therein.

Several advantages may be realized by the present invention. First, locating the wiring within the COP facilitates access to the wiring, thereby minimizing the amount of time necessary to service the lighting. In addition, locating the wiring within the COP obviates the need to work outside of the car and therefore the associated danger. Second, locating the lighting in the COP permits the ceiling to be used creatively for architectural detail. Third, locating the lighting in the COP allows the components normally disposed in a COP, such as the buttons and indicator lights, to be illuminated from behind.

These and other objects, features, and advantages of the present invention will become more apparent in light of the following detailed description of a best mode embodiment thereof, as illustrated in the accompanying drawing.

BRIEF DESCRIPTION OF THE DRAWING(s)

BEST MODE FOR CARRYING OUT THE INVENTION

Figure 1:
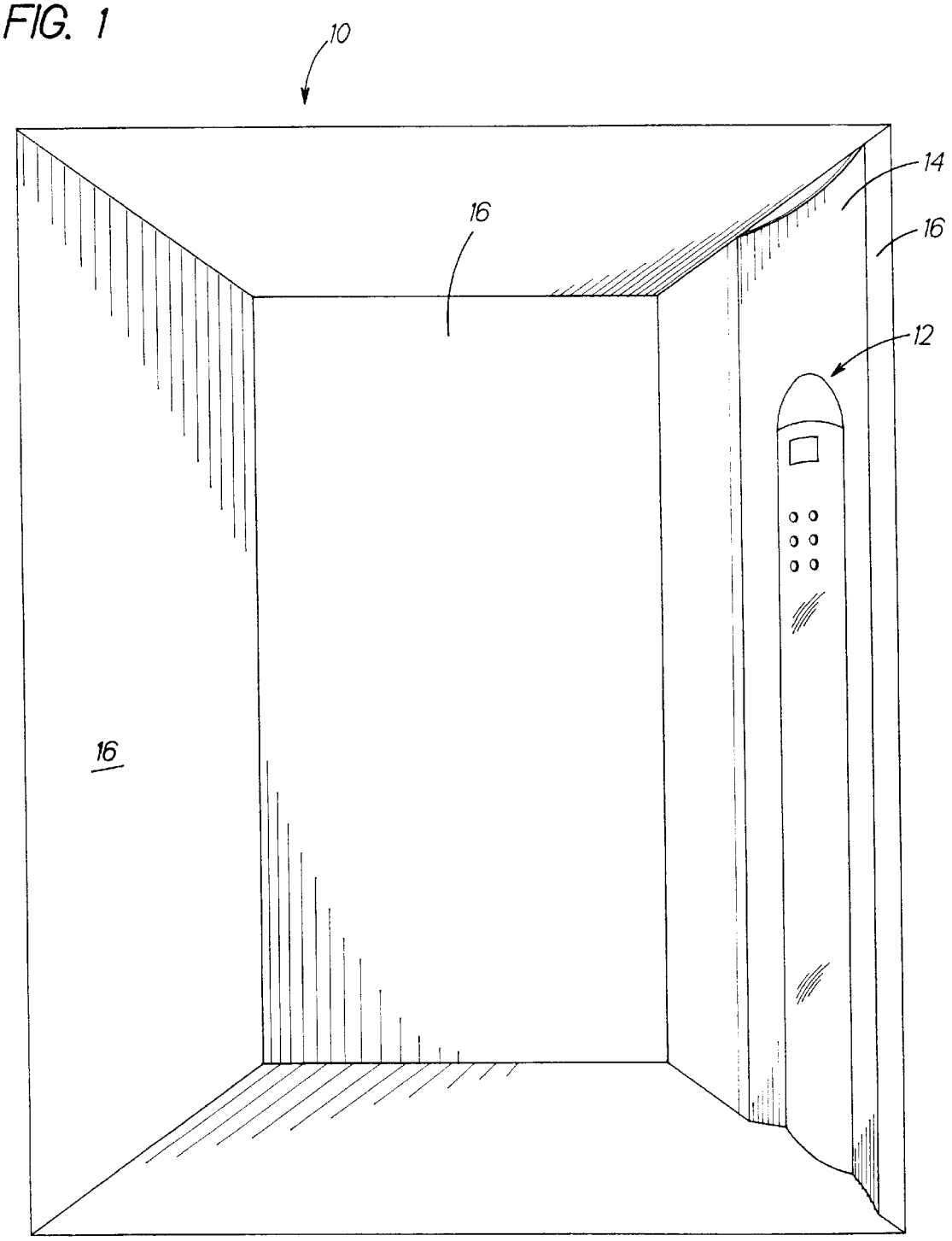
FIG. 1 is a simplified perspective view of the inside of the cab of an elevator as per the invention.

Referring to FIG. 1, an elevator cab 10 incorporating the elevator COP 12 of the invention is shown. The cab 10 comprises four wall panels 16, one of which includes a concave wall portion 14 for receiving the elevator COP 12. One of ordinary skill in the art using the teachings of this invention will recognize that the concave wall portion 14 may be placed anywhere within the cab 10.

Figure 2:
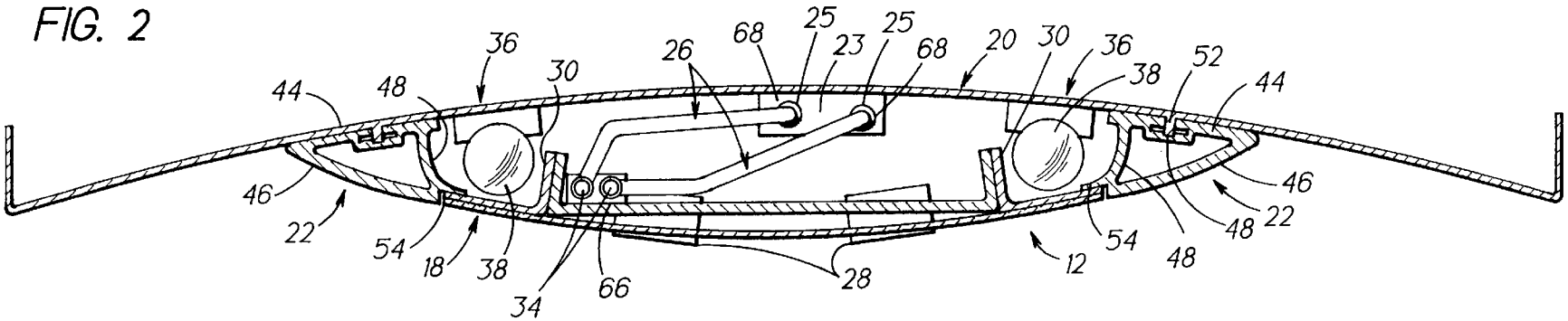
FIG. 2 is a view along cross-sectional view of the COP shown in FIG. 1, with the door of the COP closed.

Referring to FIG. 2, a top view of the COP 12 is shown. The COP 12 comprises a convex cover 18, a concave back portion 20, a pair of side illuminating panels 22, an upper illuminating panel 24 (see FIG. 3), and a pair of shaped arms 26.

The cover 18, as shown in FIG. 2 includes several typical COP components 28, such as a liquid crystal display ("LCD"), a conventional LCD driver, a loudspeaker, floor and other operating buttons, a printed circuit board for transmitting and receiving power and signals to and from the cab top (not shown), and the traveling cable (not shown). The components 28 may have translucent portions to allow light from within the COP 12 to pass therethrough to allow passengers to see them more easily. Signals from the cab top are from safeties, door operators and the like.

The cover 18 has a pair of flanges 30 depending towards the back portion 20 for reflecting the light in the COP 12 towards the illuminated side panels 22 as will be discussed infra. The cover 18 has a pair of first brackets 32, each having a pair of first pivots 34 thereon. The first brackets 32 are attached to one of the flanges 30.

Figure 3:
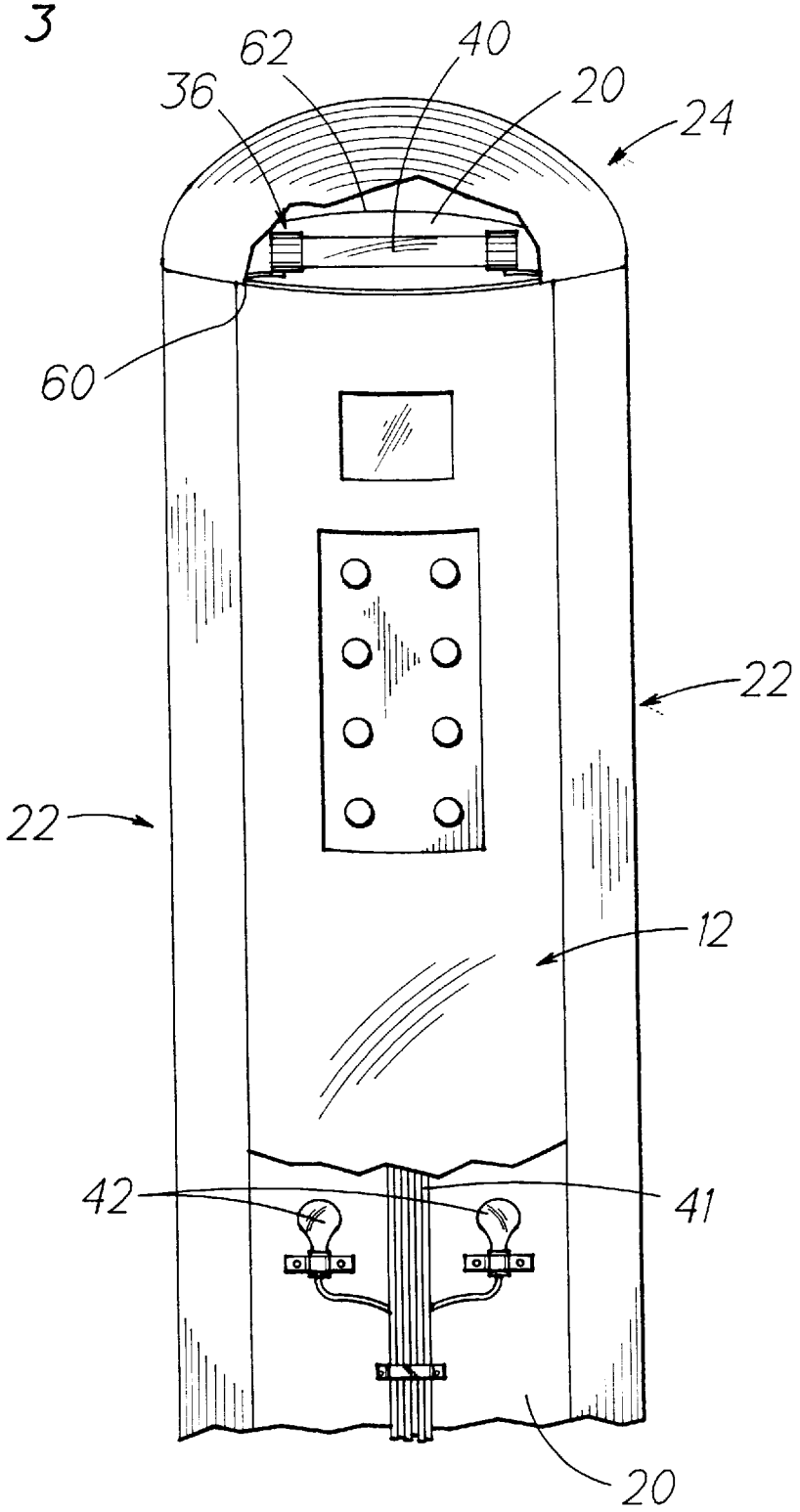
FIG. 3 is a front view of the COP of FIG. 1.

A means 36 for illuminating both the cab 10 and the COP 12 is attached to the back portion 20 of the COP 12. In the preferred embodiment, the illuminating means 36 comprises a pair of florescent bulbs 38 conventionally mounted in a vertical fashion on either side of the back portion 20. The illuminating means 36 further comprises a smaller fluorescent bulb 40, as shown in FIG. 3, mounted horizontally at the top of the back portion 20. As is known in the art, each fluorescent bulb 38,40 has a ballast and a starter (not shown) for proper operation. A pair of incandescent bulbs 42 (see FIG. 3) for emergency lighting, are also attached to the back portion 20. All the bulbs are conventionally connected to the terminal board 41 as is known in the art.

Figure 2A:
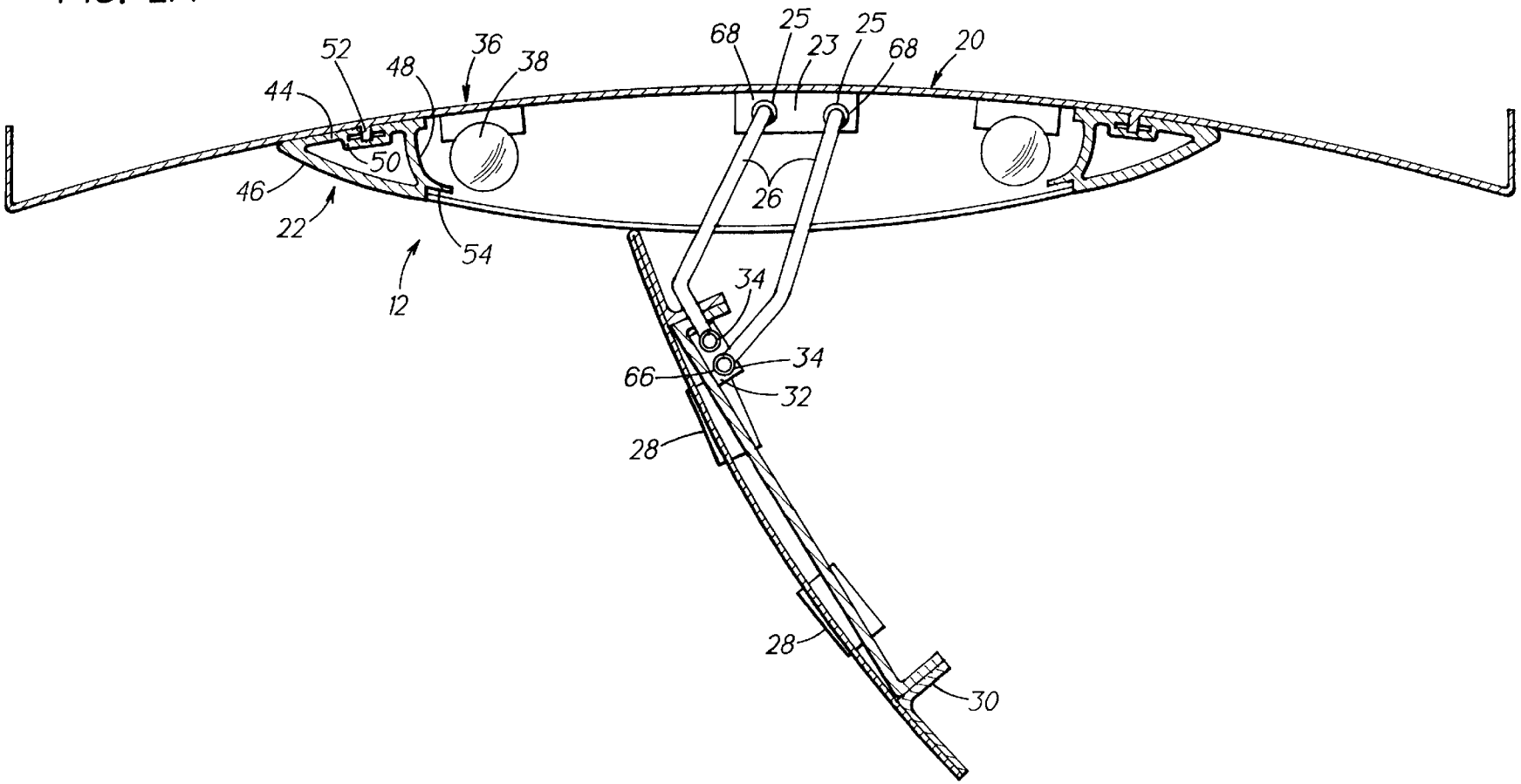
FIG. 2A is a view along cross-sectional view of the COP shown in FIG. 1, with the door of the COP open.

Referring to FIGS. 2 and 2A, the back portion 20 also has a pair of second brackets 23 attached conventionally thereto, each second bracket 23 having a pair of second pivots 25 mounted thereon.

The side illuminating panels 22 each have a roughly triangular shape comprising a first convex leg 44, a second concave leg 46, and a third leg 48 connecting the first 44 and second 46 legs. The first convex leg 44 extends along the back portion 20 and includes a slot 50 for receiving a stud 52 extending out from the back portion 20. A person of ordinary skill in the art will recognize that the slot 50 and stud 52 arrangement between the first convex leg 44 and the back portion 20 generically represents a male and female mating pair. The second concave leg 46 is attached to one end of the first leg 44. The position and curvature of the second concave leg 46 is such that it smoothly continues the curvature of the cover 18 from the back portion 20 to the cover 18. The third leg 48, which connects the first 44 and second leg 46 has a lip 54 for receiving an edge of the cover 18. The side illuminating panels 22 are constructed of an impact and scratch resistant, translucent material as is known in the art.

Referring to FIG. 3, the upper illuminating panel 24 is attached to an upper edge of the COP 12. The upper illuminating panel 24 has a half-moon shape having a lower edge 60 conforming to the convex shape of the cover 18 and the side illuminating panels 22, and a back edge 62 conforming to the shape of the back portion 20. As with the side illuminating panels 22, the upper illuminating panel 24 is constructed of an impact and scratch resistant, translucent material.

When the bulbs are lit in the side illuminating panels 22 and the upper illuminating panel 24, light emanates from the illuminating panels 22,24 and bathes the cab 10.

Referring to FIGS. 2 and 2A, the cover 18 is pivotly attached to the back portion 20 of the COP 12 by two pairs of shaped arms 26 having two ends. The first ends 66 of each pair of shaped arms 26 are pivotly attached to the first brackets 32 by the first pivots 34. The second ends 68 of the shaped arms 26 are pivotly attached to the second brackets 23 by the second pivots 25.

The second pivots 25 allow the arms 26 and cover 18 to rotate in a counterclockwise direction together, relative to the back portion 20. The first pivots 34, conversely, allows the cover 18 to rotate relative to the arms 26 in a clockwise direction. By utilizing the compound motion of the cover 18 as permitted by the pivots 23,34, the cover 18 may be rotated for easy access to the components 28 attached to the cover 18 as well as the components in the COP 12, no matter where the COP 12 is mounted in the cab 10.

Although the invention has been shown and described with respect to a best mode embodiment thereof, it should be understood by those of ordinary skill in the art that the foregoing and various other changes, omissions and additions in the form and detail thereof may be make herein without departing from the spirit and scope hereof.

What is claimed is:

1. A car operating panel for an elevator cab having a plurality of walls, said panel comprising:

a convex cover cooperating with one of said walls to define an enclosed space therebetween, a lighting source disposed within said space, said lighting source providing the primary source of light for said cab, and lighting means cooperating with said cover for allowing the light to emanate from the car operating panel to provide said primary source.

2. The car operating panel of claim 1 further comprising:

said one of said walls having a concave portion for cooperating with said convex cover to form said enclosed space.

3. The car operating panel of claim 1 further comprising:

means for attaching said cover to said wall such that said cover pivots in a counterclockwise and/or a clockwise direction away from said one of said walls to permit easy access to said space wherever said cover is mounted in said cab.

4. The car operating panel of claim 1 wherein said lighting means comprises:

a vertical first translucent panel attaching said cover to said wall.

5. The car operating panel of claim 4 further comprising:

a second translucent panel disposed atop said cover and connecting said cover to said wall.

6. A car operating panel for an elevator cab comprising:

a concave backing, a convex cover cooperating with said concave backing to define an enclosed space therebetween, a lighting source disposed within said space, said lighting source providing the primary source of light for said cab, and means cooperating with said cover for allowing the light to emanate from the car operating panel to provide said primary source.

7. The car operating panel of claim 6 further comprising:

means for attaching said cover to said backing such that said cover pivots in a counterclockwise and/or a clockwise direction away from said backing to permit easy access to said space wherever said cover is attached in said cab.

8. The car operating panel of claim 6 wherein said lighting means comprises:

a vertical first translucent panel attaching said cover to said wall.

9. The car operating panel of claim 8 further comprising:

a second translucent panel disposed atop said over and connecting said cover to said backing.

* * * * *